US009863329B2

(12) United States Patent
Vaginet et al.

(10) Patent No.: US 9,863,329 B2
(45) Date of Patent: Jan. 9, 2018

(54) THROTTLE VALVE AND INTERNAL COMBUSTION ENGINE COMPRISING SUCH A THROTTLE VALVE

(71) Applicant: ILLINOIS TOOL WORKS INC., Glenview, IL (US)

(72) Inventors: Dominique Vaginet, Saint Bernard (FR); Philippe Granier, Lyons (FR)

(73) Assignee: ILLINOIS TOOL WORKS INC., Glenview, IL (US)

( * ) Notice: Subject to any disclaimer, the term of this patent is extended or adjusted under 35 U.S.C. 154(b) by 46 days.

(21) Appl. No.: 14/906,357

(22) PCT Filed: Jun. 16, 2014

(86) PCT No.: PCT/US2014/042476
§ 371 (c)(1),
(2) Date: Jan. 20, 2016

(87) PCT Pub. No.: WO2015/012974
PCT Pub. Date: Jan. 29, 2015

(65) Prior Publication Data

US 2016/0160764 A1 Jun. 9, 2016

(30) Foreign Application Priority Data

Jul. 26, 2013 (FR) ..... 13 57419

(51) Int. Cl.
*F02D 9/16* (2006.01)
*F02D 9/02* (2006.01)
*F02D 9/10* (2006.01)

(52) U.S. Cl.
CPC ..... *F02D 9/16* (2013.01); *F02D 9/02* (2013.01); *F02D 9/101* (2013.01); *F02D 9/108* (2013.01); *F02D 9/1045* (2013.01)

(58) Field of Classification Search
CPC ... F02D 9/16; F02D 9/02; F02D 9/101; F02D 9/1045; F02D 9/108; F02D 9/08
(Continued)

(56) References Cited

U.S. PATENT DOCUMENTS 4,420,438 A * 12/1983 Goosen ..... F02D 9/101 251/305
6,055,953 A * 5/2000 Weickel ..... F01L 7/02 123/190.1

(Continued)

FOREIGN PATENT DOCUMENTS

CH 244235 A 8/1946
DE 102010008740 A1 8/2011

(Continued)

OTHER PUBLICATIONS

ISR and WO for PCT/US2014/042476 dated Aug. 25, 2014.

*Primary Examiner* — Mahmoud Gimie
(74) *Attorney, Agent, or Firm* — Hauptman Ham, LLP

(57) ABSTRACT

The present invention relates to a throttle valve adapted to equip an air intake system in an internal combustion engine, in particular an explosion engine. The throttle valve comprises: a body delimiting an air intake pipe; a valve member mounted rotatably in the pipe about an axis of rotation and comprising a spherical portion shutting off the pipe in the closed configuration; means for moving the valve member in rotation about the axis of rotation between different configurations of the throttle valve; and a bearing ring which receives a spherical outer surface of the valve member in sliding bearing contact. The throttle valve is characterized in that it also comprises a seal which is elastically deformable, which is arranged between the body and the bearing ring and which is adapted to take up forces to which the valve member and the bearing ring are subjected during a back-fire
(Continued)

through the pipe. The invention also relates to an internal combustion engine, in particular an explosion engine, comprising such a throttle valve.

20 Claims, 5 Drawing Sheets

(58) Field of Classification Search
USPC ..... 123/337; 137/15.18, 15.22; 251/315.01
See application file for complete search history.

(56) References Cited

U.S. PATENT DOCUMENTS

| | | | | |
|---|---|---|---|---|
| 6,206,023 | B1 * | 3/2001 | Landers | F16K 5/0673 137/15.18 |
| 6,948,699 | B1 | 9/2005 | Keiser | |
| 2011/0120414 | A1 * | 5/2011 | Quantz | F02D 9/16 123/337 |

FOREIGN PATENT DOCUMENTS

| | | | |
|---|---|---|---|
| EP | 1783341 | A1 | 5/2007 |
| FR | 2666395 | A1 | 3/1992 |
| FR | 2757569 | A1 | 6/1998 |
| WO | 0225085 | A1 | 3/2002 |
| WO | 2004015258 | A2 | 2/2004 |

* cited by examiner

THROTTLE VALVE AND INTERNAL COMBUSTION ENGINE COMPRISING SUCH A THROTTLE VALVE

RELATED APPLICATIONS

The present application is a National Phase of International Application Number PCT/US2014/042476 filed Jun. 16, 2014 and claims priority to French Application Number 1357419 filed Jul. 26, 2013.

The present invention relates to a throttle valve adapted to equip an air intake system in an internal combustion engine, in particular an explosion engine. The invention also relates to an internal combustion engine comprising such a throttle valve. The field of the invention is that of internal combustion engines, in particular explosion engines, adapted to equip vehicles, tools or machines.

In a conventional manner, an internal combustion engine is equipped with an air or gas intake system comprising a valve known as a throttle valve, positioned between an air filter and an intake manifold. The throttle valve comprises an air intake pipe and a flap, generally of planar shape, mounted rotatably in the pipe. The intake of air into the manifold is regulated as a function of the angular position of the flap in the pipe.

FR-A-2 666 395 describes an example of a throttle valve, comprising a flap in the form of a planar ellipse. The intake pipe comprises a circular bore in which projections are formed. The faces of these projections, which are directed toward the center of the bore and cooperate with the periphery of the flap, comprise shapes providing a variation in the air or gas flow passage cross section as the angular orientation of the flap changes, namely a small increase in cross section in a first stage followed by a sudden increase in cross section up to maximum opening during the remainder of the travel of the flap.

In practice, the flap equipping the throttle valve must have a sufficient mechanical strength to withstand a possible back-fire, corresponding to a shock wave rising in the air intake system. For example, such a shock wave can be generated during a sudden deceleration of a vehicle equipped with an explosion engine, owing, for example, to the sudden release of the accelerator control by the driver.

A planar flap mounted pivotably on a shaft in the throttle valve is poorly suited to withstand this shock wave. If the flap is over-dimensioned, the bulk of the throttle valve increases. If the flap is made of metal rather than of plastic, the weight and the cost of manufacturing the throttle valve increase. Furthermore, the elements constituting the air intake system are preferably made of plastic to allow the manufacture of compressible engine upper parts which are compatible with the regulations concerning pedestrian impact.

Sealing in the air intake pipe is achieved by fitting the planar flap in the bore of this pipe. In order to obtain a sufficient sealing level, the interface between the flap and the bore must not have excessive clearance, which is difficult to manage with elements made of plastic.

Moreover, a planar flap mounted pivotably on a shaft in the throttle valve does not allow complete opening of the air intake pipe, owing to the presence of this shaft. In fact, the internal aerodynamics of the throttle valve are not optimized.

FR-A-2 757 569 describes another example of a throttle valve, comprising a valve member provided with a spherical portion shutting off the pipe in a closed configuration. The throttle valve also comprises a bearing ring which receives a spherical outer surface of the valve member in sliding bearing contact. The bearing ring delimits an opening for air circulation through the pipe, which is shut off by the spherical portion of the valve member in the closed configuration.

The aim of the present invention is to propose an improved throttle valve.

Accordingly, the subject of the invention is a throttle valve adapted to equip an air intake system in an internal combustion engine, in particular an explosion engine, the throttle valve comprising: a body delimiting an air intake pipe; a valve member mounted rotatably in the pipe about an axis of rotation and comprising a spherical portion shutting off the pipe in a closed configuration; means for moving the valve member in rotation about the axis of rotation between different configurations of the throttle valve, including an open configuration and the closed configuration; and a bearing ring which is arranged in a housing of the body, which receives a spherical outer surface of the valve member in sliding bearing contact, which delimits an opening for air circulation through the pipe and which is adapted to take up forces to which the valve member is subjected during a back-fire through the pipe, the spherical portion of the valve member shutting off the opening in the closed configuration. The throttle valve is characterized in that it also comprises a seal which is elastically deformable, which is arranged between the body and the bearing ring and which is adapted to take up forces to which the valve member and the bearing ring are subjected during a back-fire through the pipe.

Thus, the spherical portion, the bearing ring and the seal make it possible to improve the mechanical strength of the throttle valve when the valve member is subjected to a back-fire.

The spherical portion is adapted to shut off the pipe by bearing on a complementary bearing surface of conical or toric shape (planar contact) formed on the bearing ring, and not by fitting the valve member in the bore of this pipe. Consequently, an optimum sealing level is ensured in the closed configuration. Furthermore, a tolerance relating to the angular position of the valve member about its axis of rotation is permitted, with different positions during the closure and at the start of the opening of the valve member. The invention also allows complete opening of the pipe in the open configuration, by contrast with a planar flap comprising a shaft arranged across the pipe. The spherical portion moves aside completely in the open configuration, being housed on one side of the body in the pipe. The air passage cross section and the aerodynamics of the throttle valve can therefore be optimized.

According to other advantageous features of the invention, taken in isolation or in combination:

- In cross section, the seal has a body having a V-shaped profile delimiting a hollow.
- The valve member is made of plastic.
- The valve member also comprises an annular portion secured to the spherical portion and delimiting an opening for air circulation through the pipe in the open configuration.
- The valve member comprises lateral shafts which extend out of the pipe and are rotatable about the axis in housings delimited in the body.
- The valve member does not comprise a central shaft situated in the pipe.
- In the open configuration, the spherical portion of the valve member is housed on a side of the pipe in the body, without locally reducing the air passage cross section between an upstream orifice and a downstream orifice of the pipe.

The spherical portion of the valve member comprises a convex outer surface and a concave inner surface each having a spherical profile.

The spherical portion of the valve member has a concave spherical surface oriented toward a downstream orifice of the pipe, through which orifice a back-fire is capable of rising in the pipe.

The valve member comprises a lateral shaft cooperating with the means for moving the valve member about the axis of rotation.

The body comprises a first casing part and a second casing part together delimiting a housing for receiving a lateral shaft belonging to the valve member.

A peripheral seal is arranged at a joint plane between the first casing part and the second casing part.

The peripheral seal comprises a portion offset on an outer side of the housing with respect to the pipe, whereas the housing and the lateral shaft do not comprise a seal.

Another subject of the invention is an internal combustion engine, in particular an explosion engine, comprising such a throttle valve.

The invention will be better understood on reading the following description given purely by way of non-limiting example and with reference to the appended drawings, in which.

Figure 1:
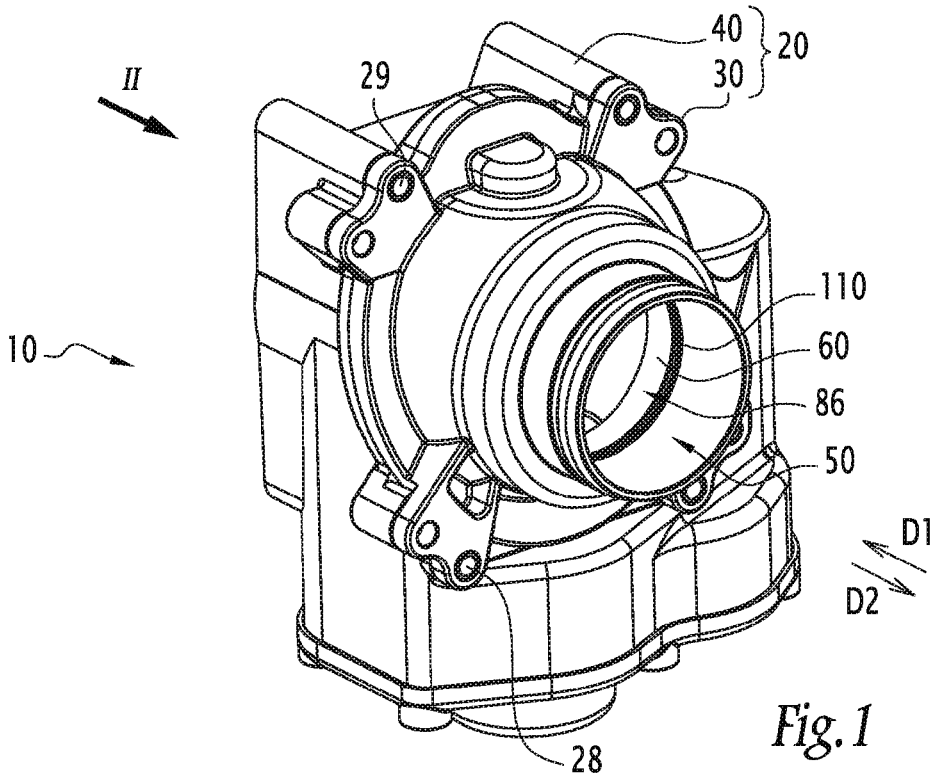
FIG. 1 is a perspective view of a throttle valve according to the invention.
Figure 2:
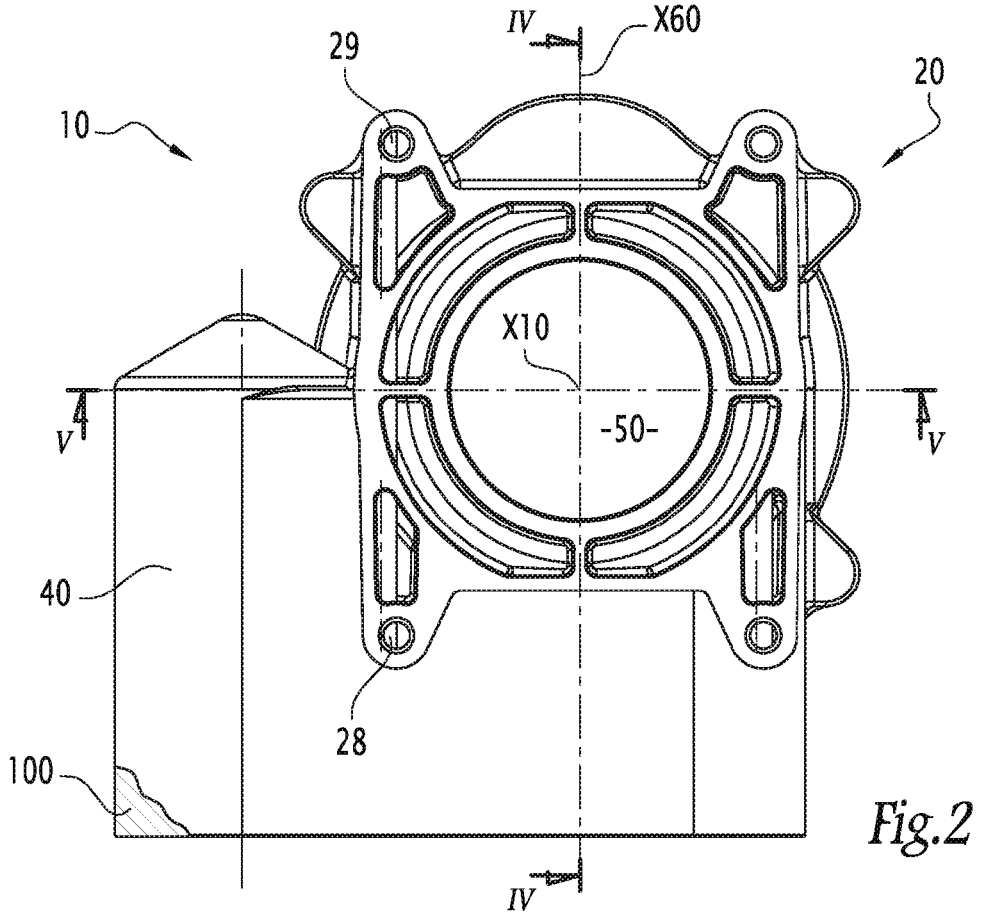
FIG. 2 is an elevation view in the direction of the arrow II in FIG. 1.
Figure 3:
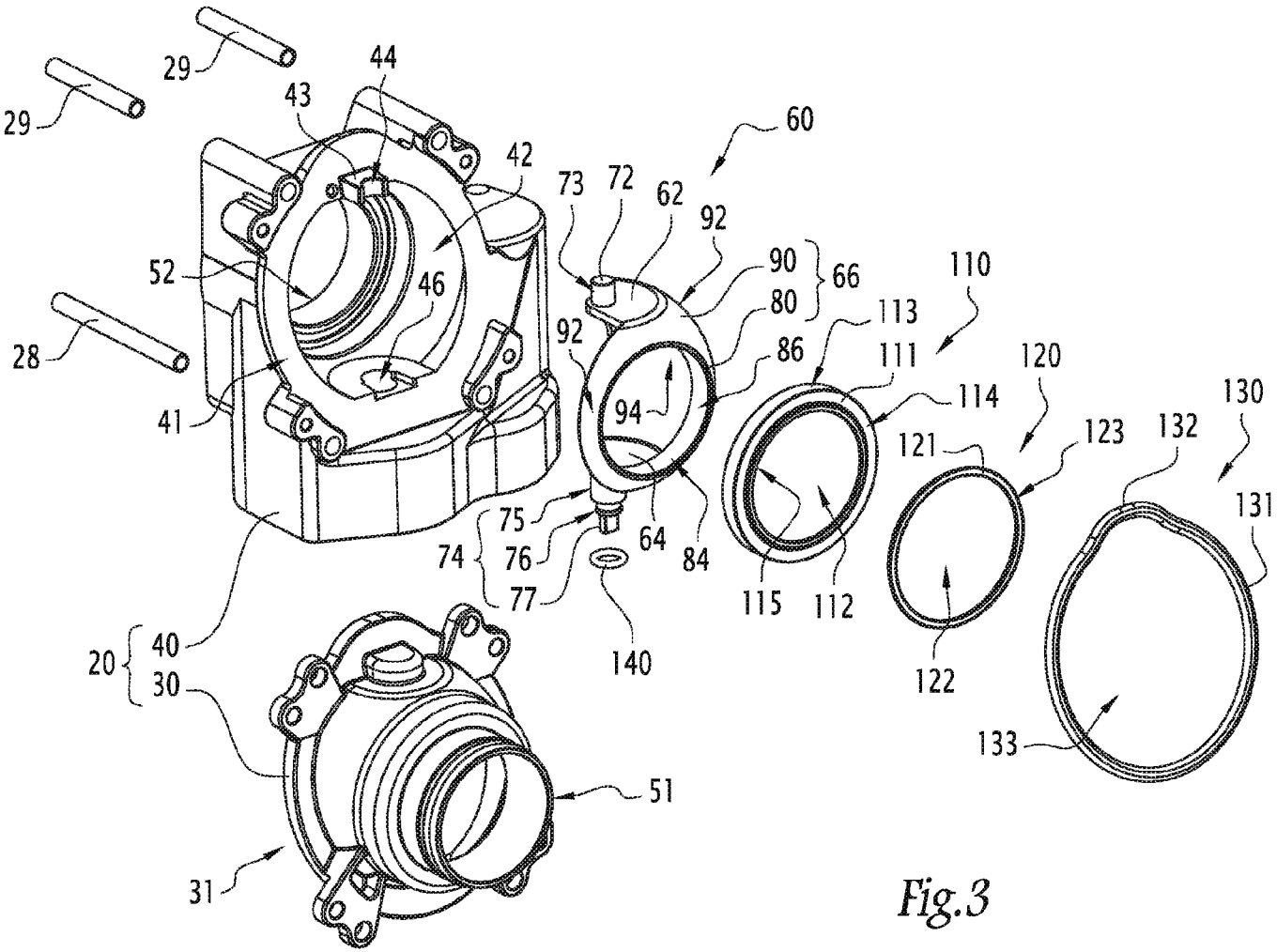
FIG. 3 is an exploded perspective view of the throttle valve.
Figure 4:
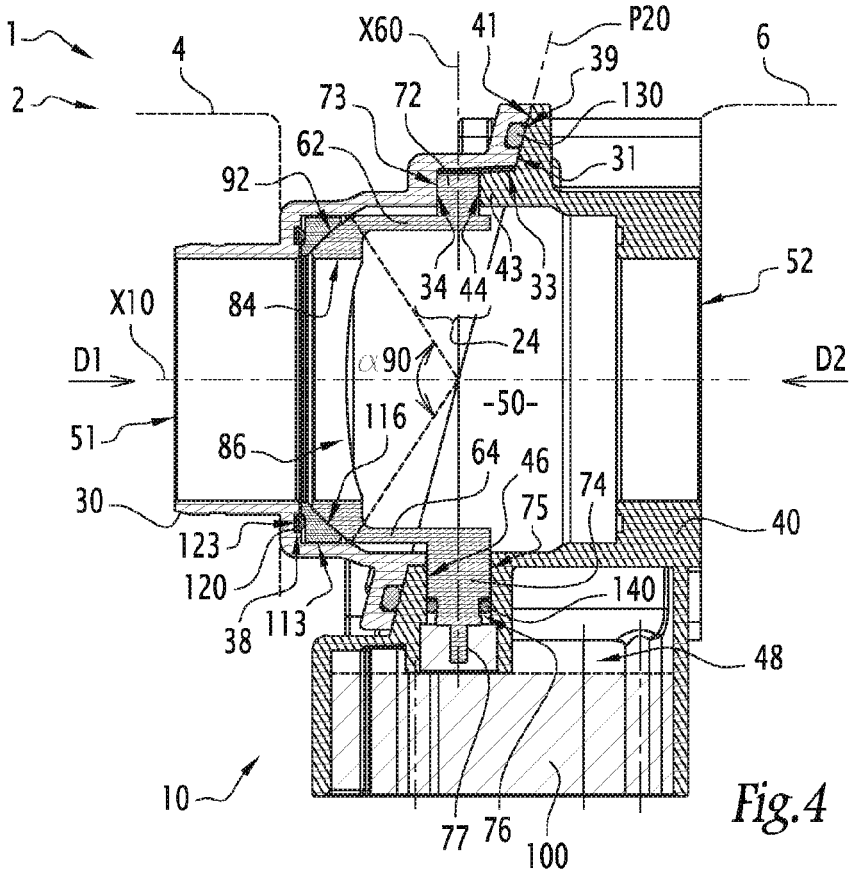
FIGS. 4 and 5 are sections, on the line IV-IV and on the line V-V in FIG. 2 respectively, showing the throttle valve in an open configuration.

FIGS. 1 to 7 show a throttle valve 10 according to the invention, adapted to equip an air intake system 2 of an internal combustion engine 1, also according to the invention.

The intake system 2 is intended to let an air or gas flow into the engine 1 The system 2 comprises in particular an air filter 4, an intake manifold 6 and the throttle valve 10. The engine 1 and the system 2 are represented partially in FIG. 4 for the purpose of simplification. More specifically, the filter 4 and the manifold 6 are represented partially and schematically by dashed lines in FIG. 4. The filter 4 is arranged upstream of the throttle valve 10, whereas the manifold 6 is arranged downstream of the throttle valve 10, Preferably, all the elements constituting the system 2 are made of plastics materials, which are lighter and more economic than metal and make it possible moreover to produce compressible engine upper parts which are compatible with the regulations concerning pedestrian impact.

The throttle valve 10 comprises a body 20 formed by an upstream casing 30 and a downstream casing 40, an air intake pipe 50 delimited in the body 20, a valve member 60 mounted rotatably in the pipe 50 about an axis of rotation X60, an actuator device 100 adapted to move the valve member 60 in rotation about its axis X60, a bearing ring 110 for the valve member 60 during a back-fire in the pipe 50, and three seals 120, 130 and 140. The various elements 30, 40, 60, 110, 120, 130, 140 constituting the throttle valve 10 are each made of plastic, in particular of thermoplastic or of elastomer depending on their function within the throttle valve 10. For the purpose of simplification, the actuating device 100 is represented partially and schematically by a hatched block in FIGS. 4 and 5.

There is defined a longitudinal axis X10 of the throttle valve 10, corresponding overall to the central axis of the pipe 50. Also defined are two directions D1 and D2 which are parallel to the axis X10 and directed oppositely, namely the direction D1 in which the air let into the engine 1 flows through the throttle valve 10 and the direction D2 in which a back-fire is capable of occurring in the throttle valve 10.

Figure 5:
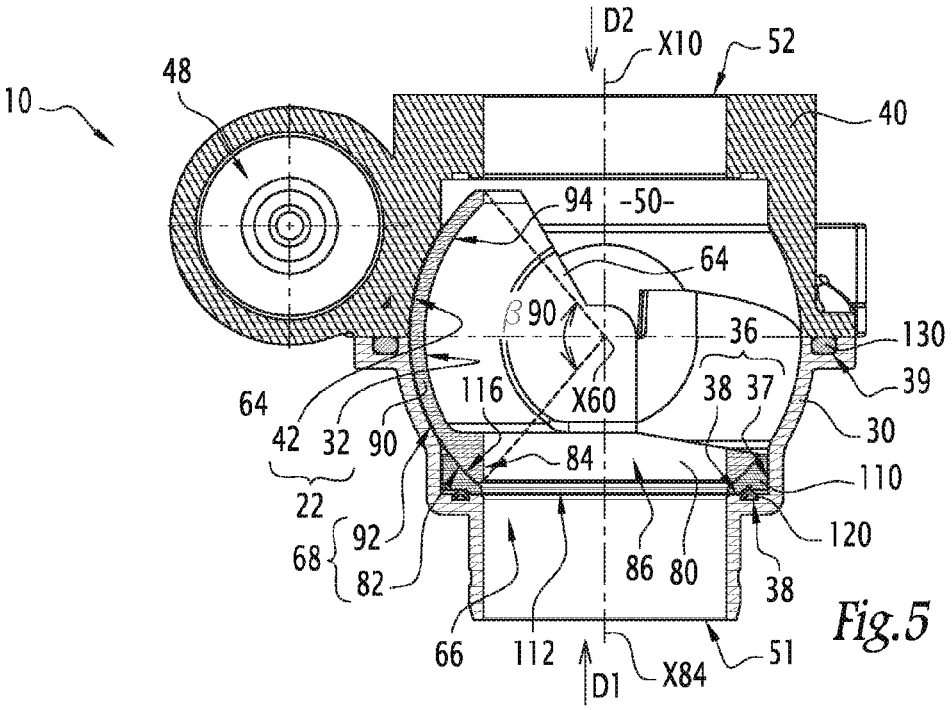
Figure 6:
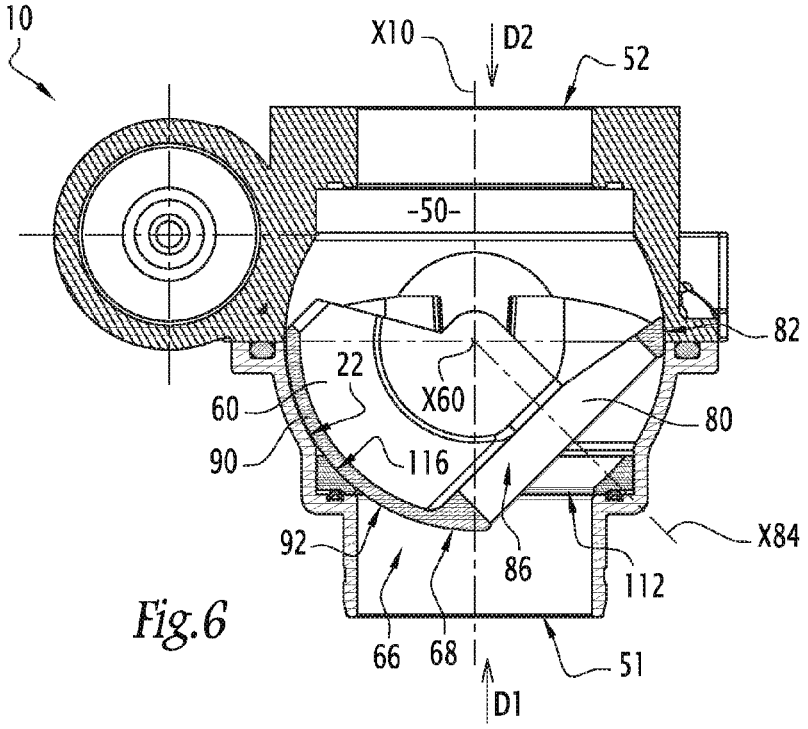
FIG. 6 is a section analogous to FIG. 5, showing the throttle valve in an intermediate configuration.
Figure 7:
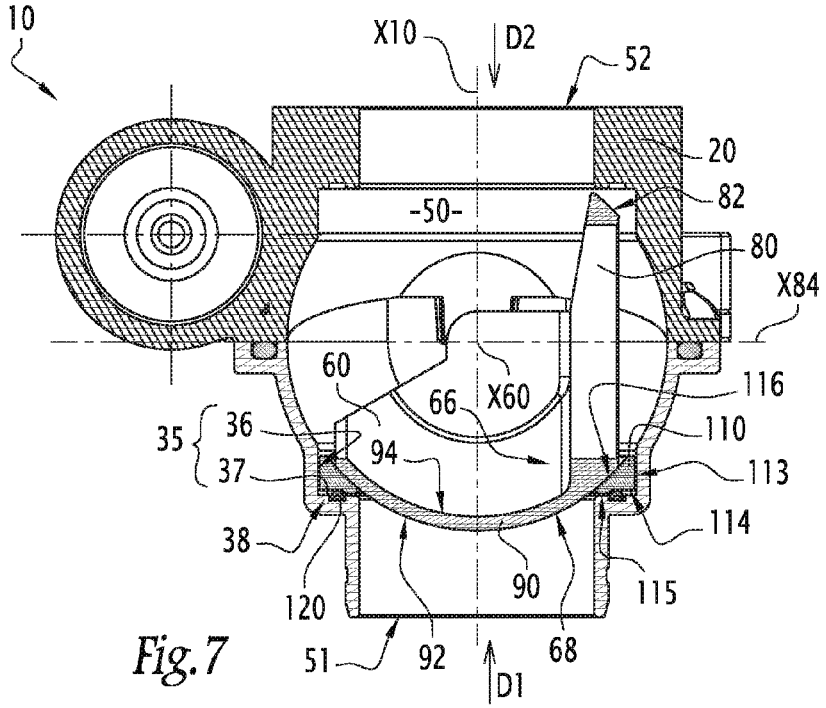
FIG. 7 is a section analogous to FIG. 5, showing the throttle valve in a closed configuration.

The throttle valve 10 and in particular the valve member 60 are shown in an open configuration in FIGS. 1, 2, 4 and 5, in an intermediate configuration in FIG. 6 and in a closed configuration in FIG. 7. In practice, the valve member 60 is provided to selectively allow the air or gas flow to flow through the pipe 50 in the open configuration or to shut off the pipe 50 in a sealed manner in the closed configuration. The valve member 60 is also movable in different intermediate configurations between the open configuration and the closed configuration.

Each configuration of the throttle valve 10 corresponds to a given angular orientation of the valve member 60 in the pipe 50 and therefore to a given cross section for air passage through this pipe 50. The intermediate configurations can be qualified as semi-open configurations, by distinction with the open configuration which can be qualified as fully open configuration of the pipe 50. Only the closed configuration, which can be qualified as a sealed shut-off configuration of the pipe 50, prevents the air or gas from flowing through the pipe 50, both in the direction D1 and in the direction D2.

The body 20 is formed by assembling the casings 30 and 40, once the elements 60, 110, 120, 130 and 140 are positioned in these casings 30 and 40. This assembly is produced using centering rods 28 and 29 of different lengths, and fastening screws which have not been shown for the purpose of simplification. The casings 30 and 40 each comprise a planar surface, 31 and 41 respectively. The surfaces 31 and 41 bear against one another when the body 20 is assembled. The surfaces 31 and 41 are then situated in a joint plane P20 inclined with respect to the axes X10 and X60, that is to say not parallel and not perpendicular to each of the axes X10 and X60. The seal 130 is arranged at the joint plane P20, as detailed herein below.

The casings 30 and 40 each comprise a concave inner surface, 32 and 42 respectively. When the body 20 is assembled, the surfaces 32 and 42 together define a concave inner surface 22 of the body 20. In the example of FIGS. 1 to 7, this surface 22 forms a sphere portion centered both on the axis X10 and on the axis X60. This surface 22 delimits a hollow in the body 20, provided to receive the valve member 60 during its pivoting about the axis X60. A clearance between the surface 22 and the valve member 60 allows the valve member 60 to rotate without friction against the surface 22 of the body 20. In an alternative, the surface 22 can have any shape allowing the valve member 60 to be housed in the body 20, with rotation without friction.

The casing 30 comprises a hollow 33 formed at the surface 31. The hollow 33 delimits a surface 34 forming a cylinder portion which is open in the direction D1. The casing 40 comprises a projection 43 which extends in the direction D2 from the surface 41. The projection 43 delimits a surface 44 forming a cylinder portion which is open in the direction D2. The projection 43 is adapted to be housed in the hollow 33, with the result that the surfaces 34 and 44 together form a housing 24 of cylindrical shape intended to receive the valve member 60 in a pivot connection. The casing 40 also comprises a housing 46 of cylindrical shape provided to receive the valve member 60 in a pivot connection. The casing 40 also comprises a housing 48 of complex shape, provided to receive the various elements constituting the actuator device 100. The housing 48 communicates with the pipe 50 via the housing 46. The casing 40 also comprises a removable cover 49, provided to close or open the housing 48 with the aim of gaining access to the device 100.

The casing 30 comprises an annular housing 35 centered on the axis X10 and provided to receive the bearing ring 110 on the orifice 51 side. This housing 35 is delimited by a cylindrical bore 36 and a planar annular surface 37 which is directed in the direction D1. In the casing 30 there is formed an annular groove 38, centered on the axis X10 and opening at the surface 37 in the direction D1. The groove 38 is provided to receive the seal 120 while the ring 110 rests against the surface 37. In the casing 30 there is also formed a groove 39 opening at the surface 31 in the direction D1. The groove 39 has an annular overall shape, except at the hollow 33 where this groove 39 is offset toward the outside of the body 20 away from the axis X10. The groove 39 is provided to receive the seal 130.

The pipe 50 comprises an upstream orifice 51 formed in the upstream casing 30 and a downstream orifice 52 formed in the downstream casing 40, The upstream orifice 51 is connected to the filter 4, whereas the downstream orifice 52 is connected to the manifold 6. In other words, when the air intake system 2 is in normal operation, the air or gas flow enters the pipe 50 through the orifice 51 and leaves it through the orifice 52 while flowing in the direction D1. On the other hand, when a back-fire occurs in the system 2, the shock wave enters the pipe 50 through the orifice 52 and propagates in the direction of the orifice 51 in the direction D2.

The valve member 60 makes it possible to regulate the air passage cross section in the pipe 50 and to block the shock wave during a back-fire. The valve member 60 comprises two substantially planar lateral parts 62 and 64 connected by an intermediate part 66. The lateral parts 62 and 64 are arranged on the side of the pipe 50 in the body 20, without locally reducing the air passage cross section in the pipe 50. Each lateral part 62 and 64 bears a shaft, 72 and 74 respectively, which extends in a direction opposite to the intermediate part 66 from this lateral part 62 or 64. The valve member 60 is advantageously monobloc, formed integrally, that is to say that its constituent elements 62, 64, 66, 72 and 74 are manufactured in a single operation, in particular by injection molding. By contrast with a planar flap, the valve member 60 does not comprise a central shaft extending across the pipe 50. The shafts 72 and 74 are situated out of the pipe 50, on either side of this pipe 50, as detailed herein below.

The shafts 72 and 74 are both completely centered on the axis X60. The shaft 72 comprises a cylindrical surface 73 which is centered on the axis X60 and provided to be mounted in a pivot connection in the body 20, more precisely in the housing 24 defined between the surfaces 34 and 44. The shaft 74 comprises a cylindrical surface 75 which is centered on the axis X60 and provided to be mounted in a pivot connection in the body 20, more precisely in the housing 46 formed in the casing 40. The shaft 74 also comprises an annular groove 76 provided to receive the annular seal 140. The shaft 74 also comprises an end-piece 77 provided to cooperate with the actuator device 100 with the aim of rotating the valve member 60 about the axis X60. The end-piece 77 has overall a parallelepipedal shape and a rectangular cross section radially to the axis X60. In an alternative, the end-piece 77 can have any shape and/or cross section adapted to cooperate with the actuator device 100, for example a hexagonal cross section.

The intermediate part 66 comprises an annular portion 80 and a spherical portion 90, which are integral and partly coincident. The intermediate part 66 of the valve member 60 is provided to selectively allow the air or gas flow to flow through the pipe 50 in the open configuration or shut off the pipe 50 in a sealed manner in the closed configuration. More precisely, the air flow passes through the annular portion 80 in the open or intermediate configuration and is blocked by the spherical portion 90 in the closed configuration of the throttle valve 10.

The annular portion 80 comprises a convex outer surface 82, having a spherical profile centered at the intersection of the axes X10 and X60. The annular portion 80 also comprises a cylindrical bore 84 centered on an axis X84, which is aligned with the axis X10 in the open configuration. The bore 84 passes through the annular portion 80 between its outer surface 82 and its inner face oriented toward the axis X60. This bore 84 delimits an opening 86 for air passage through the valve 60 in the open or intermediate configuration. Owing to the presence of the bore 84 and the opening 86, the surface 82 forms a ring centered on the axis X84.

The spherical portion 90 comprise a convex outer surface 92 and a concave inner surface 94, each having a spherical profile centered at the intersection of the axes X10 and X60. The surface 92 is oriented away from the axis X60, whereas the surface 94 is oriented toward the axis X60. The spherical portion 90 does not comprise a through-opening formed between the surfaces 92 and 94. The spherical portion 90 has a spherical overall shape but does not constitute a complete sphere. In other words, the spherical portion 90 can be qualified as a sphere portion centered at the intersection of the axes X10 and X60.

It will be noted at this stage that the surfaces 82 and 92 form one and the same spherical outer surface 68, defined on the intermediate part 66 of the valve member 60. The surfaces 82 and 92 overlap at the junction of the portions 80 and 90. The surface 68 forms a sphere portion centered at the intersection of the axes X10 and X60. The surface 68 is provided to slide on the bearing ring 110 when the valve member 60 pivots about the axis X60, with a clearance formed between the surface 68 of the valve member 60 and the surface 22 of the body 20.

The actuating device 100 makes it possible to move the valve member 60 between the different configurations of the throttle valve 10, including the open configuration, the closed configuration and the different intermediate configurations. In other words, the device 100 comprises means for moving the valve member 60 in rotation about the axis X60, for example a reduction motor assembly. The elements constituting the device 100 are positioned in the housing 48, which is accessible by demounting the removable cover 49 when the body 20 is assembled.

The bearing ring 110 is arranged in the housing 35 of the body 20 on the orifice 51 side. The ring 110 comprises a body 111 of annular overall shape, centered on the axis X10 when this body 111 is arranged in the housing 35. The body 111 delimits a central air-passage opening 112 in the pipe 50. The body 111 has an outer cylindrical surface 113 provided to be housed in the bore 37 of the casing 30. On the side arranged facing the surface 38 of the casing 30, the body 111 has a substantially planar annular surface 114 and an annular projection 115. The surface 114 is connected to the surface 113, whereas the projection 115 delimits the outer edge of the opening 112. The seal 120 is arranged in bearing contact against the surface 114, around the projection 115.

Likewise, the body 111 of the ring 110 comprises a surface 116 forming a sphere portion, which is centered at the intersection of the axes X10 and X60 when the ring 110 is positioned in the housing 35. Owing to the presence of the opening 112, the surface 116 has a ring profile centered on the axis X10. In cross section in a plane including the axis X10 and perpendicular to the axis X60, the surface 116 is situated substantially as a continuation of the surface 32, as shown in FIG. 5. The surface 116 is provided to receive the outer surface 68 of the valve member 60 in sliding sealed bearing contact. The surface 116 forms a complementary bearing surface for the surface 68. In other words, the bearing ring 110 forms a sealing seat for the valve member 60. The bearing ring 110 is made of a flexile material which is resistant to temperature and allows easy sliding of the valve member 60. In a preferred but nonlimiting manner, the ring 110 can be produced on the basis of polytetrafluoroethylene (PTFE), either pure (machined) or as main filler (of the order of 15%) of a polyamide (PA)-type or polyethersulfone (PES)-type polymer accompanied by glass fibers.

The seal 120 comprises a body 121 of annular overall shape delimiting a central opening 122. In cross section, the body 121 has a V-shaped profile delimiting a hollow 123. The seal 120 is provided to be arranged in the groove 38, between the casing 30 and the bearing ring 110. The hollow 123 is thus directed toward the base of the groove 38.

The seal 130 comprises a body 131 of annular overall shape, except at a portion 132 offset toward the outside. The body 131 delimits a central opening 133. When the peripheral seal 130 is positioned in the groove 39, the portion 132 is offset with respect to the remainder of the body 131 away from the axis X10. In other words, the portion 132 is offset on an outer side of the housing 24 with respect to the pipe 50. In an advantageous manner, the shape and the arrangement of the seal 130 make it possible to assemble the throttle valve 10 without providing that the housing 24 and the lateral shaft 72 comprise an additional seal, by contrast with the housing 46 and with the shaft 74 which comprise the seal 140 arranged in the groove 76. The seal 130 is also used as a "spring" to keep the seal 120 in contact with the valve member 60.

The operation of the valve member 60 is described herein below.

In the open configuration shown in FIGS. 1, 2, 4 and 5, the valve member 60 is oriented angularly such that the annular portion 80 is arranged against the bearing ring 110. The surface 82 is in sealed bearing contact against the surface 116. The opening 86 is aligned with the orifices 51 and 52 along the axis X10. At the same time, the spherical portion 90 is housed on the side of the pipe 50 in the body 20, without locally reducing the air-passage cross section in the pipe 50. A clearance is formed between the surface 92 and the surface 22.

In the intermediate configuration shown in FIG. 6, the angular orientation of the valve member 60 and therefore the air flow passage cross section in the pipe 50 vary. The flow passes through the openings 86 and 112. The surface 68 slides on the surface 116. A clearance is formed between the surfaces 22 and 68.

In the closed configuration shown in FIG. 7, the valve member 60 is oriented angularly such that the spherical portion 90 is arranged against the bearing ring 110 and shuts off the opening 112. The surface 92 is in sealed bearing contact against the surface 116. At the same time, the annular portion 80 is housed on the side of the pipe 50 in the body 20. A clearance is formed between the surface 82 and the surface 22. The ring 110 is adapted to take up the forces to which the valve member 60 is subjected during a back-fire through the pipe 50. In addition, the seal 120 is adapted to take up the forces to which the valve member 60 and bearing ring 110 are subjected during a back-fire through the pipe 50, The seal 120 is deformed elastically by being crushed in its groove 38, which is facilitated by the presence of the hollow 123.

Figure 8:
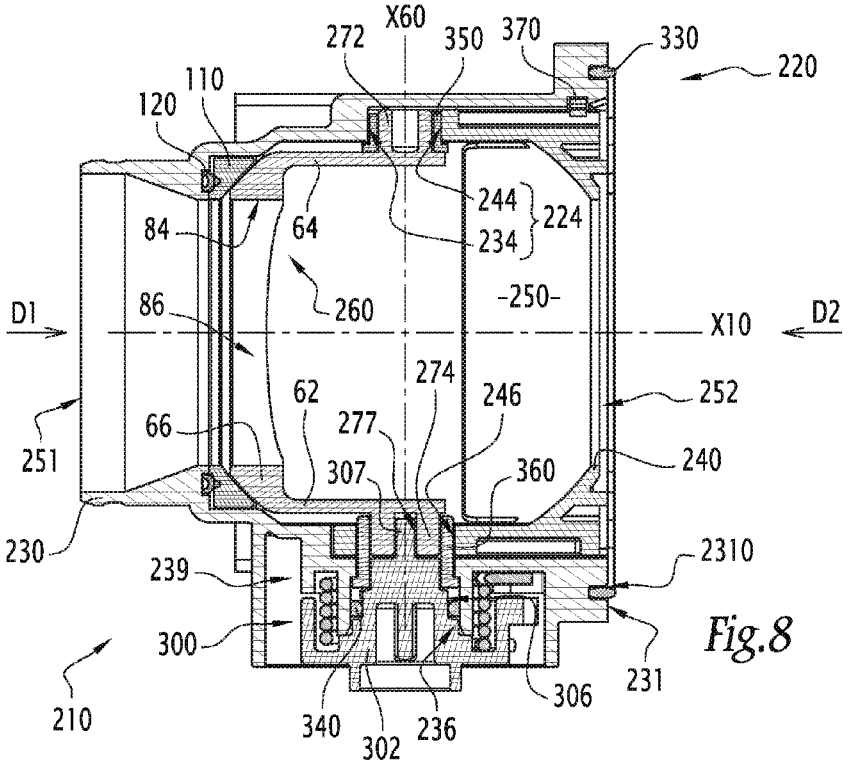
FIGS. 8 and 9 are sections, analogous to FIGS. 4 and 5 respectively, of a throttle valve according to a second embodiment of the invention.
Figure 9:
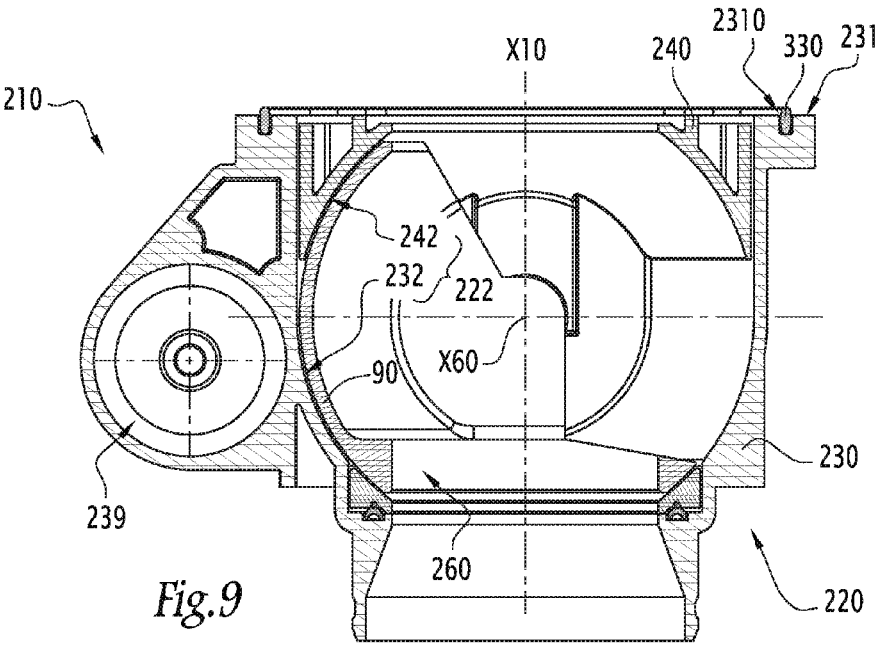

FIGS. 8 and 9 show a throttle valve 210 according to a second embodiment of the invention.

Certain elements constituting the throttle valve 210 are similar to the elements constituting the throttle valve 10, described above, and bear the same reference numbers. Only the differences with the throttle valve 10 are described herein below for the purpose of simplification.

The throttle valve 210 comprises a body 220 formed by an upstream casing 230 and a downstream casing 240, an air intake pipe 250 delimited in the body 220, a valve member 260 mounted rotatably in the pipe 250 about an axis of rotation X60, an actuator device 300 adapted to move the valve member 260 in rotation about its axis X60, a bearing ring 110 for the valve member 260 during a back-fire in the pipe 250, three seals 120, 330 and 340, two substantially annular rings 350 and 360, and an indexing member 370. The pipe 250 comprises an upstream orifice 251 formed in the upstream casing 230 and a downstream orifice 252 formed in the downstream casing 240.

The actuator device 300 is partially represented in FIG. 8 and is not represented in FIG. 9 for the purpose of simplification. The device 300 comprises in particular a component 302 completely centered on the axis X60. The component 302 comprises a cylindrical surface 306 receiving the seal 340, interposed between this surface 306 and a cylindrical bore 236 of the casing 230. The component 302 also comprises an end-piece 307 provided to cooperate with the valve member 260 in order to rotate it about the axis X60.

The valve member 260 comprises parts 62, 64 and 66 similar to the valve member 60, in particular the spherical portion 90. Each lateral part 62 and 64 bears a shaft, 272 and 274 respectively, which extends in a direction opposite to the intermediate part 66 from this lateral part 62 or 64 and is completely centered on the axis X60. The shaft 272 has a tubular shape, in other words, this shaft 272 is cylindrical and hollow. The shaft 274 comprises an inner groove 277 provided to cooperate with the end-piece 307 belonging to the actuator device 300 for the purpose of rotating the valve member 260 about the axis X60. The end-piece 307 has overall a parallelepipedal shape and a rectangular cross section radially to the axis X60. In an alternative, the groove 277 and the end-piece 307 can have any shape and/or cross section adapted to cooperate with one another, for example hexagonal cross sections.

By comparison with the embodiment, the casing 230 is larger than the casing 30, whereas the casing 240 is smaller than the casing 40. The body 220 has smaller dimensions than the body 20. A member 370 is provided for mounting the casing 240 in the casing 230, The points for fastening the body 220 to the filter 4 and to the manifold 6 are closer to the axis X10 than in the case of the body 20.

The casings 230 and 240 each comprise a concave inner surface, 232 and 242 respectively, together defining a concave inner surface 222 of the body 220. This surface 222 forms a hollow in the body 220, provided to receive the valve member 260 during its pivoting movement about the axis X60. A clearance between the surface 222 and the valve member 260 allows a rotation of the valve member 260 without friction against the surface 222 of the body 220. In an alternative, the surface 222 can have any shape making it possible to house the valve member 260 in the body 220, with rotation without friction. The casing 230 comprises a concave surface 234 forming a cylinder portion which is open in the direction D1, whereas the casing 240 comprises a concave surface 244 forming a cylinder portion which is open in the direction D2. The surfaces 234 and 244 together form a housing 224 of cylindrical shape provided to receive the ring 350, which itself receives the shaft 272 of the valve member 260 in a pivot connection. The casing 240 also comprises a housing 246 of cylindrical shape provided to receive the ring 360, which itself receives the shaft 274 of the valve member 260 in a pivot connection.

In the casing 230 there is formed an annular groove 2310, centered on the axis X10 and opening at the surface 231 in the direction D1. The groove 2310 is provided to receive the seal 330, interposed between the body 220 and the intake manifold 6 when the throttle valve 210 is mounted in the air intake system 2.

The casing 230 also comprises a housing 239 of complex shape, provided to receive the various elements constituting the actuator device 300. The housing 239 communicates with the pipe 250 via the housing 246, in which the ring 360, the shaft 274 and the end-piece 307 of the component 302 are arranged. The casing 240 also comprises a removable cover, not shown for the purpose of simplification, provided to close or open the housing 239 in order to gain access to the device 300.

The throttle valve 210 advantageously makes it possible to dispense with the seal 130 arranged between the casings 30 and 40 of the throttle valve 10, thereby making it possible to improve the reliability of the sealing within the throttle valve 210 and to reduce the bulk of the throttle valve 210. In addition, the mounting of the throttle valve 210 in the system 2 is facilitated. If appropriate, automation can be envisioned.

Moreover, the engine 1, the intake system 2 and/or the throttle valve 10 or 210 can be configured differently from FIGS. 1 to 9 without departing from the scope of the invention.

In a variant, not shown, the body 20/220 of the throttle valve 10/210 can have a different shape, being as compact as possible.

According to another variant, not shown, the valve member 60/260 and its constituent parts can have different shapes. Whatever the embodiment, the valve member 60/260 comprises a spherical portion 90 shutting off the pipe 50/250 in the closed configuration.

According to another variant, not shown, the bearing ring 110 can be arranged on the orifice 52/252 side instead of on the orifice 51/251 side. In this case, the concave surface 94 is directed towards the orifice 51/251 and the convex surface 92 is directed towards the orifice 52/252 in the closed configuration.

Furthermore, all or some of the technical features of the various embodiments and variants mentioned above can be combined with one another. Thus, the throttle valve can be adapted in terms of cost, functionality and performance.

The invention claimed is:

1. A throttle valve adapted to equip an air intake system in an internal combustion engine, in particular an explosion engine, the throttle valve comprising:

a body delimiting an air intake pipe;

a valve member mounted rotatably in the pipe about an axis of rotation and comprising a spherical portion shutting off the pipe in a closed configuration;

means for moving the valve member in rotation about the axis of rotation between different configurations of the throttle valve, including an open configuration and the closed configuration; and a bearing ring which is arranged in a housing of the body, which receives a spherical outer surface of the valve member in sliding bearing contact, which delimits an opening for air circulation through the pipe and which is adapted to take up forces to which the valve member is subjected during a back-fire through the pipe, the spherical portion of the valve member shutting off the opening in the closed configuration;

wherein the throttle valve also comprises a seal which is elastically deformable, which is arranged between the body and the bearing ring and which is adapted to take up forces to which the valve member and the bearing ring are subjected during a back-fire through the pipe.

2. The throttle valve as claimed in claim 1, wherein, in cross section, the seal has a body having a V-shaped profile delimiting a hollow.

3. The throttle valve as claimed in claim 1, wherein the valve member is made of plastic.

4. The throttle valve according to claim 1, wherein the valve member also comprises an annular portion secured to the spherical portion and delimiting an opening for air circulation through the pipe in the open configuration.

5. The throttle valve as claimed in claim 1, wherein the valve member comprises lateral shafts which extend out of the pipe and are rotatable about the axis in housings delimited in the body.

6. The throttle valve as claimed in claim 5, wherein the valve member does not comprise a central shaft situated in the pipe.

7. The throttle valve as claimed in claim 1, wherein, in the open configuration, the spherical portion of the valve member is housed on a side of the pipe in the body, without locally reducing the air passage cross section between an upstream orifice and a downstream orifice of the pipe.

8. The throttle valve as claimed in claim 1, wherein the spherical portion of the valve member comprises a convex outer surface and a concave inner surface each having a spherical profile.

9. The throttle valve as claimed in claim 1, wherein the spherical portion of the valve member has a concave spherical surface oriented toward a downstream orifice of the pipe, through which orifice a back-fire is capable of rising in the pipe.

10. The throttle valve as claimed in claim 1, wherein the valve member comprises a lateral shaft cooperating with the means for moving the valve member about the axis of rotation.

11. The throttle valve as claimed in claim 1, wherein the body comprises a first casing part and a second casing part together delimiting a housing for receiving a lateral shaft belonging to the valve member.

12. The throttle valve as claimed in claim 11, wherein a peripheral seal is arranged at a joint plane between the first casing part and the second casing part.

13. The throttle valve as claimed in claim 12, wherein the peripheral seal comprises a portion offset on an outer side of the housing with respect to the pipe, whereas the housing and the lateral shaft do not comprise a seal.

14. An internal combustion engine, in particular an explosion engine, wherein it comprises a throttle valve as claimed in claim 1.

15. The throttle valve as claimed in claim 1, wherein the seal is in direct contact with the bearing.

16. The throttle valve as claimed in claim 1, wherein the bearing is an annular bearing that extends about a path of air flow from the air intake pipe into the valve member.

17. The throttle valve as claimed in claim 1, wherein the axis of rotation extends in a direction normal to an axis about which the seal extends.

18. The throttle valve as claimed in claim 1, wherein the seal is coaxial with an interior of the air intake pipe leading to the valve member.

19. The throttle valve as claimed in claim 1, wherein the valve member includes lugs that support the valve member, the lugs extending from the valve member in the direction of the axis of rotation, and the seal and the bearing are spaced completely away from the lugs.

20. The throttle valve as claimed in claim 1, wherein the wherein the valve member includes lugs that support the valve member, and an inner diameter of the bearing is many times larger than the outer diameter of the lugs.

* * * * *